United States Patent [19]

Naganuma et al.

[11] Patent Number: 4,664,048

[45] Date of Patent: May 12, 1987

[54] ZIGZAG SEWING MACHINE WITH FABRIC-EDGE TRACING FUNCTION

[75] Inventors: Nobuyuki Naganuma; Yasuhiro Shimizu, both of Nagoya, Japan

[73] Assignee: Brother Kogyo Kabushiki Kaisha, Japan

[21] Appl. No.: 859,810

[22] Filed: May 5, 1986

[30] Foreign Application Priority Data

May 11, 1985 [JP] Japan ..... 60-100177

[51] Int. Cl.[4] ..... D05B 3/02

[52] U.S. Cl. ..... 112/453; 112/153; 112/306

[58] Field of Search ..... 112/153, 453, 456, 457, 112/121.11, 308, 306, 443

[56] References Cited

U.S. PATENT DOCUMENTS 3,650,229 3/1972 Rovin ..... 112/153 X
4,423,690 1/1984 Willenbacher ..... 112/153 X

FOREIGN PATENT DOCUMENTS 1081169 8/1967 United Kingdom .
1149855 4/1969 United Kingdom .
1312602 4/1973 United Kingdom .

*Primary Examiner*—Peter Nerbun
*Attorney, Agent, or Firm*—Parkhurst & Oliff

[57] ABSTRACT

A zig zag sewing machine having a feed device for feeding a workpiece in a feed direction on a work bed, an endwise reciprocable needle bar for carrying a needle, and a support member joggable laterally with respect to the feed direction and supporting the needle bar, including a detector having a light emitting portion and a light receiving portion and disposed on the support member for detecting the edge of the workpiece extending in the feed direction. The detector is movable laterally with respect to the feed direction in a predetermined positional relation with the support member at least when the support member is laterally moved. The lateral positions of the support member and the detector are changed by a driving device which is controlled so that an amount of light received by the light receiving portion coincides with a predetermined amount, whereby successive stitches to be formed by the needle are placed on a line which is away from the workpiece edge by a predetermined constant distance.

7 Claims, 5 Drawing Figures

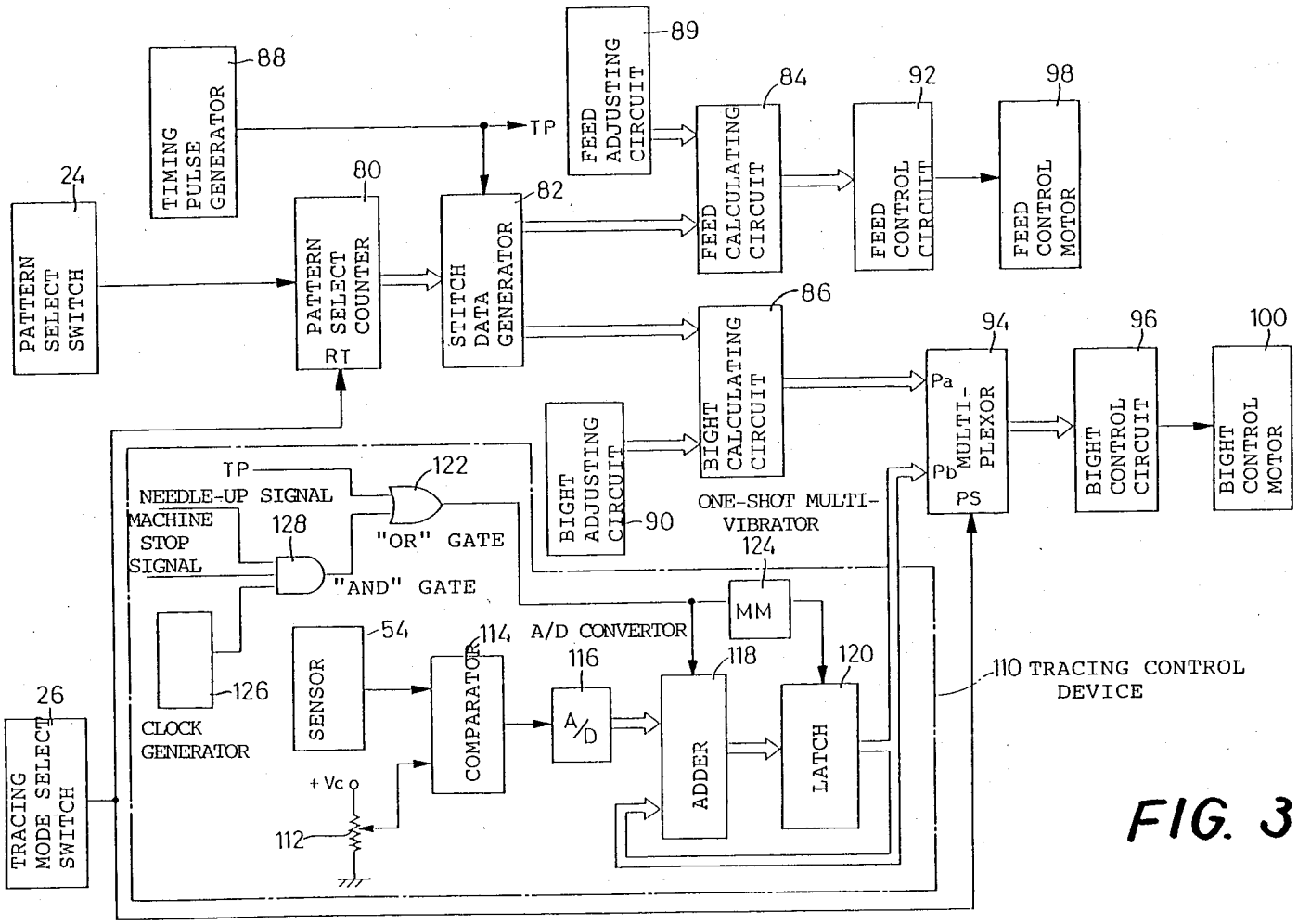
FIG. 3
TRACING MODE SELECT SWITCH
26
PATTERN SELECT SWITCH
24
TIMING PULSE GENERATOR
88
PATTERN SELECT COUNTER
80
RT
STITCH DATA GENERATOR
82
TP
FEED ADJUSTING CIRCUIT
89
FEED CALCULATING CIRCUIT
84
BIGHT CALCULATING CIRCUIT
86
BIGHT ADJUSTING CIRCUIT
90
FEED CONTROL CIRCUIT
92
FEED CONTROL MOTOR
98
MULTI-PLEXOR
94
Pa
Pb
PS
BIGHT CONTROL CIRCUIT
96
BIGHT CONTROL MOTOR
100
110 TRACING CONTROL DEVICE
ONE-SHOT MULTI-VIBRATOR
124
MM
LATCH
120
ADDER
118
A/D CONVERTOR
116
A/D
COMPARATOR
114
SENSOR
54
+Vc
112
"OR" GATE
122
"AND" GATE
128
TP
NEEDLE-UP SIGNAL
MACHINE STOP SIGNAL
CLOCK GENERATOR
126

ZIGZAG SEWING MACHINE WITH FABRIC-EDGE TRACING FUNCTION

BACKGROUND OF THE INVENTION

The present invention relates generally to a zig zag sewing machine, and more particularly to a sewing machine having an arrangement for tracing the edge of a workpiece (hereinafter referred to as "fabric edge") and sewing a line of stitches a constant predetermined distance away from the fabric edge.

A zig zag sewing machine having an arrangement for following the fabric edge to sew a seam along the fabric edge is known according to the disclosure in U.S. Pat. No. 4,248,168. In the disclosed sewing machine, the location of the fabric edge is sensed by an edge sensor, and the lateral needle jogging mechanism is controlled in response to a signal generated by the sensor, so as to sew a line of stitches a predetermined distance from the fabric edge.

As described in the above-identified U.S. Patent, a zig zag sewing machine which inherently has a lateral needle jogging function to change the needle position in the direction normal to the feed direction of a work fabric, may be adapted to sew a line of stitches along the edge of the fabric while following or tracing the fabric edge, by adding a sensor to detect the fabric edge, and other simple devices responsive to the sensor.

In the arrangement disclosed in the above-identified U.S. Patent, the edge sensor is of a light-transmission type including a photosensor which is mounted on a work bed and whose output signal corresponds to an area which is covered by the work fabric. The needle is moved in the lateral direction by a distance corresponding to the level of the output signal. For accurate sensing of the fabric edge, therefore, the edge sensor must have a linearity of the output signal at least over an area of detection within which the fabric edge is expected to be moved. To this end, the sewing machine must use an expensive sensor for accurate detection of the fabric edge. Further, the control device responsive to the edge sensor must have hardware or software provisions for converting the output signal of the photosensor into a lateral jogging motion of the needle. In this respect, the control device is complicated and accordingly costly.

Another inconvenience associated with the light-transmission type of edge sensor is derived from the fact that a given amount of light transmitted through the work fabric is inevitably received by the photosensor. The amount of incidence of this undesirable light upon the photosensor is remarkably influenced by the thickness, color, material and other parameters of the work fabric. To avoid the influence or compensate for a variation in the sensor output due to the varying parameters of the work fabric, a secondary photosensor must be disposed so as to be always covered by the work fabric. The use of the secondary sensor increases the cost of the sewing machine. Furthermore, where the work fabric is a checkered or otherwise figured cloth, the edge sensing primary photosensor and the compensating secondary photosensor may be located below different color portions of the figured cloth. In this case, the secondary photosensor fails to achieve a proper amount of compensation, causing an error in the distance between the fabric edge and the line of stitches to be formed.

SUMMARY OF THE INVENTION

It is therefore an object of the present invention to provide a zig zag sewing machine having an arrangement for accurately tracing the edge of a workpiece, with a comparatively inexpensive edge sensor with a relatively narrow range of linearity in the output signal.

According to the principle of the present invention, there is provided a zig zag sewing machine having a feed device for feeding a workpiece in a feed direction on a work bed, an endwise reciprocable needle bar for carrying a needle, and a support member joggable laterally with respect to the feed direction and supporting the needle bar, comprising: detecting means having a light emitting portion and a light receiving portion and disposed in the vicinity of the needle bar, for detecting the edge of the workpiece extending in the feed direction, the detecting means being movable laterally with respect to the feed direction in a predetermined positional relation with the support member at least when the support member is laterally moved; and control means for controlling the driving means so that an amount of light received by the light receiving portion coincides with a predetermined amount, whereby successive stitches to be formed by the needle are placed on a line which is away from the edge of the workpiece by a predetermined distance.

According to one feature of the present invention, the positional relation between the detecting means and the support member is determined so that the detecting means is not movable relative to the support member. In one form of this feature of the invention, the detecting means is mounted on the support member so that the detecting means and the support member are moved together. In this case, the driving means may include a control motor operatively connected to the support member to change the lateral positions of the support member and the detecting means.

In the zig zag sewing machine of the present invention as described above, a movement of the edge of the workpiece in the lateral direction will cause a change in the amount of light received by the light receiving portion of the detecting means, resulting in a difference between the detected amount and the predetermined reference amount. The control means is responsive to the detecting means for controlling the driving means to adjust the lateral position of the support member so as to zero the above-indicated difference, and thereby change the lateral position of the needle in response to the change in the lateral position of the workpiece edge. Thus, the sewing machine is capable of forming a line of successive stitches a predetermined constant distance away from the edge of the workpiece.

Since the lateral position of the detecting means is changed in the predetermined positional relation with the lateral position of the needle as the workpiece edge detected by the detecting means is moved off the predetermined position, the center of the detection area of the detecting means is shifted with the workpiece edge, whereby the center of the detection area will not be positioned an excessively large distance away from the workpiece edge. Accordingly, the detecting means is not required to have a linear output characteristic over a wide range in the lateral direction. In other words, the present sewing machine may use a comparatively inexpensive detecting device.

Further, the instant sewing machine may use a relatively less complicated and less costly control system responsive to the detecting means. Namely, the control means provided according to the invention is adapted to control the control motor connected to the support member, so that the amount of light received by the light receiving portion coincides with the predetermined reference amount. Hence, the control means is not required to have provisions for converting the output signal of the detecting means into an amount of lateral movement of the needle.

According to another feature of the present invention, a light reflecting surface is provided on the work bed so as to extend laterally to the feed direction of the workpiece. In this case, the light emitting portion and the light receiving portion of the detecting means are both disposed above the light reflecting surface.

The sewing machine incorporating the above feature of the invention does not have to use a conventionally required secondary photoelectric sensor for compensating for a variation in the output of the edge sensor due to varying parameters of the workpiece to be handled, because a variation in the intensity of the light reflected by the workpiece due to the change in the material, color or other parameter of the workpiece is extremely smaller than a difference of the intensity of the light reflected by the reflecting surface from that of the light reflected by the workpiece. Therefore, the sewing machine is further improved in terms of its cost, and its accuracy of control of the distance between the edge of the workpiece and the line of stitches to be formed on the workpiece even when the workpiece is a checkered or otherwise figured cloth.

However, it is possible that one of the light emitting and receiving portions of the detecting means mounted support member is disposed above the workpiece while the other of the light emitting and receiving portions is disposed below the workpiece, so that the light emitted by the light emitting portion is passed through the workpiece, and the light transmitted through the workpiece is received by the light receiving portion.

According to a further feature of the invention, operator-controlled means is provided to adjust the reference amount with which the amount of light received by the light receiving portion of the detecting means is compared by the control means so as to zero the difference between the detected and reference amounts. In this arrangement, the operator may establish a desired spacing between the workpiece edge and the line of stitches to be formed along the edge.

According to another aspect of the present invention, there is provided a zig zag sewing machine having stitch forming instrumentalities including an endwise reciprocable needle joggable laterally with respect to a feed direction of a workpiece, comprising: detecting means having a light emitting portion and a light receiving portion for detecting the edge of said workpiece extending in the feed direction; operator-controlled means disposed on a machine frame and operable to adjust a distance between the workpiece edge and a line on which successive stitches are to be formed, for generating a reference signal corresponding to the adjusted distance; driving means operative to change the lateral position of the needle; and control means for controlling the driving means according to the reference signal and a detection signal corresponding to an amount of light received by the light receiving portion of the detecting means.

BRIEF DESCRIPTION OF THE DRAWINGS

The foregoing and optinal objects, features and advantages of the present invention will be better understood by reading the following detailed description of a preferred embodiment of the invention, when considered in connection with the accompanying drawings, in which:

FIG. 3 is a block schematic diagram of a control system of the sewing machine.

DETAILED DESCRIPTION OF THE PREFERRED EMBODIMENT

Figure 1:
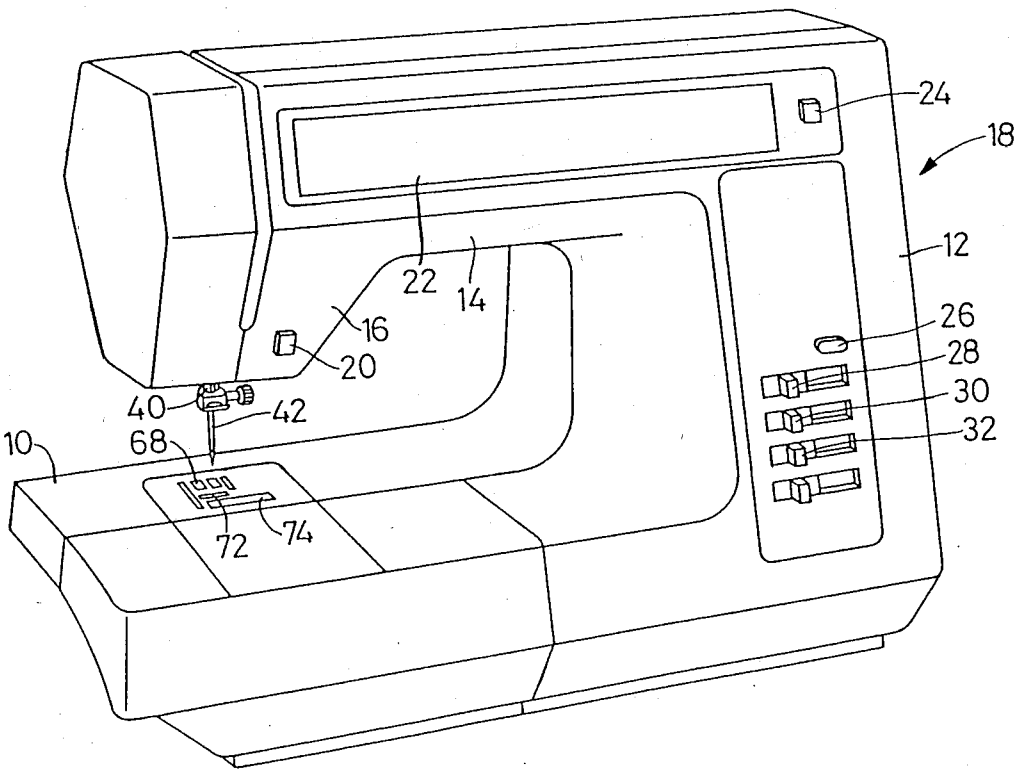
FIG. 1 is a schematic perspective view of one embodiment of an edge-tracing sewing machine of the invention, showing the exterior appearance of the sewing machine.

Referring to the drawings, the preferred embodiment of a zig zag sewing machine of the present invention will be described in detail. As illustrated in FIG. 1, the sewing machine includes a bed 10 having a flat upper surface, a standard 12 rising from the right-hand side end (as viewed in the figure) of the bed 10, a bracket arm 14 extending from the upper end of the standard 12 substantially in parallel with the bed 10, and a head 16 provided at the free end of the bracket arm 14. These members 10, 12, 14 and 16 are incorporated in a frame generally indicted at 18. The head 16 has a main switch 20 for turning on and off the sewing machine. The bracket arm 14 has a display panel 22 on which there are provided a plurality of indicia indicative of stitch patterns available on the instant sewing machine. The braket arm 14 further has a pattern select switch 24 for selecting the stitch patterns. On the standard 12, there is provided a tracing-mode select switch 26 used to place the sewing machine in a tracing-mode of operation in which a line of stitches are formed a predetermined constant distance away from the edge of a workpiece or work fabric. There are also provided on the standard 12: a width setting member 28 for setting a spacing or width (hereinafter referred to as "stitch width") between the edge of the work fabric and the line of stitches; a bight adjusting member 30; and a feed adjusting member 32.

Figure 2:
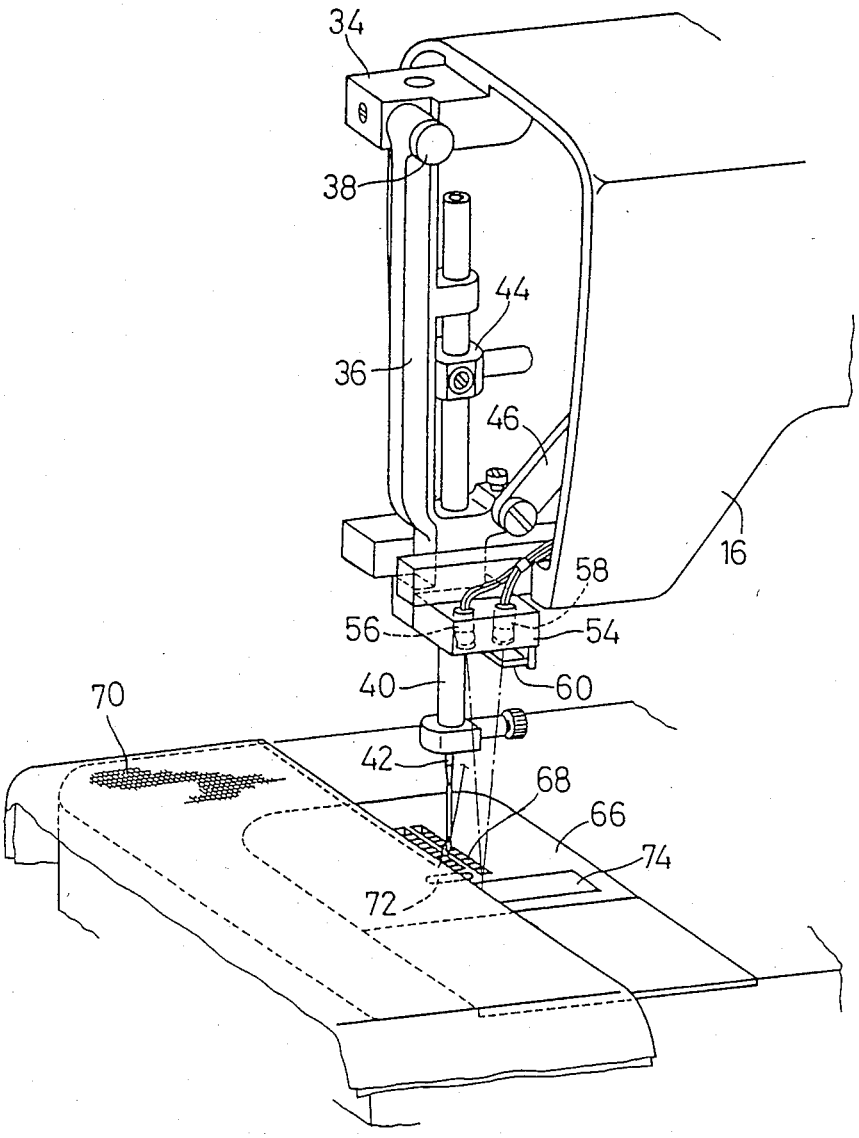
FIG. 2 is a perspective view of a head portion of the sewing machine of FIG. 1, with a head cover removed to show the interior contruction of the head portion.

Referring next to FIG. 2 showing the interior construction of the head 16 as seen with its covering member removed, a support member in the form of a needle-bar oscillator 36 is supported at its one end by a shaft 38 on a projection 34 fixed to the head 16, so that the oscillator 36 is pivotable about the shaft 38 in the vertical plane. On this oscillator 36 is supported a needle bar 40 slidably in the vertical direction. The needle bar 40 is adapted to carry a needle 42 at its lower end, and is connected to a needle drive motor (not shown) via a connecting stud 44 and other members, so that the needle bar 40 and the needle 42 are endwise reciprocated in the vertical direction during the activation of the needle drive motor. In the meantime, the needle-bar oscillator 36 is operatively connected to a bight control motor 100 (which will be described) via a connecting rod 46 and other members. With this bight control motor 100 operated, the needle bar 36 is jogged laterally with respect to a feed direction of the work fabric 70, whereby the lateral position of the needle 42 is variable within a predetermined range.

On the needle-bar oscillator 36, there is mounted a sensor 54 which is joggable together with the oscillator 36. The sensor 54 includes a light emitter 56 which emits infrared rays, and a photoelectric cell 58 which receives the reflected infrared rays as described later. In the vicinity of the photoelectric cell 58 is disposed an optical filter 60 which permits the infrared rays to pass therethrough, but blocks rays of light of other wavelength regions.

The upper surface of the bed 10 previously indicated has an aperture closed by a throat plate 66 having a plurality of slots, through which respective feed dogs 68 are adapted to protrude above the throat plate 66. The feed dogs 68 are given feeding movements by a feed control motor 98 (which will be described), and cooperate with a presser foot (not shown) to feed the work fabric 70 in the feed direction perpendicular to the direction of lateral jogging of the needle 42. The throat plate 66 further has an elongate needle hole 72 which is formed in the lateral jogging direction of the needle 42, that is, in the direction perpendicular to the feed direction of the work fabric 70. In the vicinity of the needle hole 72, a reflecting surface 74 is provided on the throat plate 66, such that the length of the surface 74 is parallel to the needle hole 72. The reflecting surface 74 reflects the infrared rays emitted by the light emitter 56 of the sensor 54, so that the reflected rays are received by the photoelectric cell 58, as previously indicated. The sensor 54 is adapted to detect an amount of the infrared rays which are reflected by a preset detection area on the reflector surface 74. The center of the detection area lies at a point which is spaced predetermined distances to the right (as seen in FIG. 2) and to the front (toward the operator) from an intersection of the centerline of the needle 42 and the plane of the upper surface of the throat plate 66 (the intersection being hereinafter referred to as "lowered position of the needle 42). The amount of light received by the photoelectric cell 58 decreases as the surface area of the detection area covered by the work fabric 70 increases, so that the photoelectric cell 58 generates a detection signal which corresponds to the surface area of the detection area which is not covered by the work fabric 70.

The schematic block diagram of FIG. 3 shows a control system of the present sewing machine. Although the control system of FIG. 3 given for illustrative purpose only takes the form of a discrete circuit, the major part of the control system may be constituted by a microcomputer. To the pattern select switch 24 indicated at the left-hand side end of the figure, there is connected a pattern select counter 80 which counts the number of operation of the select switch 24. A signal representative of the count of the pattern select counter 80 is applied to a stitch data generator 82. According to the varying count of the counter 80, the corresponding one of light emitting diodes incorporated in the display panel 22 is turned on to indicate the currently selected stitch pattern.

The stitch data generator 82 stores plural sets of stitch data representative of the respective stitch patterns that can be formed in the instant sewing machine. The stitch data generator 82 provides a feed calculating circuit 84 and a bight calculating circuit 82 with the set of stitch data which corresponds to the current count of the pattern select counter 80. Described more specifically, the stitch data generator 82 is supplied with a timing pulse which is generated by a timing pulse generator 88 each time the needle bar 40 is reciprocated. Each time the stitch data generator 82 receives the timing pulse from the pulse generator 88, feed data and bight data of the stitch data are fed to the feed and bight calculating circuits 84, 86, respectively.

A feed adjusting circuit 89 is connected to the feed calculating circuit 84, while a bight adjusting circuit 90 is connected to the bight calculating circuit 86. The feed adjusting circuit 89 supplies the feed calculating circuit 84 with feed adjusting data which is variable by the feed adjusting member 32. The feed calculating circuit 84 multiplies the feed data from the generator 82 by the feed adjusting data from the adjusting circuit 89, and a produce obtained by the multiplication is fed to a feed control circuit 92, whereby the feed data of the stored stitch data for the selected stitch pattern is adjusted according to the current position of the feed adjusting member 32. Similarly, the bight calculating circuit 86 is adapted to adjust the bight data from the stitch pattern generator 82, according to bight adjusting data from the bight adjusting circuit 90, which corresponds to the current position of the bight adjusting member 30. The bight data adjusted by the calculating circuit 86 is applied to a bight control circuit 96 via a multiplexer 94. The feed control circuit 92 controls the previously indicated feed control motor 98 to effect controlled feeding movements of the feed dogs 68, while the bight control circuit 96 controls the previously indicated bight control motor 100 to effect controlled lateral jogging movements of the needle 42. In this manner, successive stitches are formed in the pattern selected by the pattern select switch 24.

The tracing-mode select switch 26 is connected to the pattern select counter 80 and the multiplextor 94. With the select switch 26 activated, the pattern select counter 80 is reset. As a result, the stitch data representative of a straight stitch pattern is generated from the stitch data generator 82. Further, the activation of the tracing-mode select switch 26 will cause the multiplexor 94 to be switched to a position for supplying an output (hereinafter referred to as "needle position signal") of a tracing control device 110 to the bight control circuit 96, rather than the output of the bight calculating circuit 86.

The tracing control device 110 comprises the previously described sensor 54, and a variable resistor 112 which produces a reference signal. The sliding contact of the variable resistor 112 is movable as the width setting member 28 is operated. Outputs of the sensor 54 and the variable resistor 112 are applied to a comparator 114, which in turn generates an output corresponding to a difference between the outputs of the sensor 54 and the resistor 112. The output of the comparator 114 is applied to an adder 118 via an A/D converter 116. The adder 118 is adapted to add the digital output of the A/D converter 116 and a digital output of a latch 120, each time the adder 118 receives timing pulse TP from the timing pulse generator 88 via an OR gate 122. The timing pulse TP is also applied to the latch 120 via a one-shot multivibrator 124, with a time delay. The latch 120 holds the output of the adder 118, according to the delayed timing pulse.

The timing pulse generator 88 generates the timing pulse TP only while the needle bar 40 is reciprocating with the needle drive motor kept operated. A clock generator 126 is provided so as to supply the adder 118 and the latch 120 with a clock pulse similar to the timing pulse TP, even while the sewing machine is at rest. The clock pulse from the clock generator 126 is directly applied to an input of an AND gate 128 which also receives a NEEDLE-UP signal produced while the needle 42 is placed at its elevated position, and a MACHINE STOP signal produced while the needle drive motor is at rest. The clock pulse is fed from the AND gate 128 and is applied to the adder 124 and latch 120 via the OR gate 122, only when the NEED-UP and MACHINE STOP signals are both present.

In the tracing mode of operation on the zig zag sewing machine, the operator first sets the work fabric 70 on the upper surface of the bed 10, such that a line of stitches to be formed along the edge is substantially aligned with the center of the elongate needle hole 72 formed in the throat plate 66. Then, the operator activates the tracing-mode select switch 26. As a result, the pattern select counter 80 is reset, and the straight stitch pattern is selected irrespective of the stitch pattern which has been selected. In the meantime, the multiplexor 94 is switched to its position at which the needle position signal from the tracing control device 110 is passed to the bight control circuit 96.

With the work fabric 10 set on the bed 70 as described above, the sensor 54 applies to the comparator 114 its output detection signal corresponding to the surface area of the detection area on the reflector surface 74, which is not covered by the work fabric 70. The comparator 114 compares this detection signal with the reference signal from the variable resistor 112, and applies to the A/D converter 116 an analog error signal which corresponds to the differential between the detection signal and the reference signal. The analog error signal is converted by the A/D converter 116 into the corresponding digital signal, which is applied to the adder 118.

In this condition, the needle drive motor is still held at rest, and the needle 42 is placed at its elevated position. Namely, the MACHINE STOP and NEEDLE-UP signals are received by the AND gate 128, whereby the clock pulse generated by the clock generator 126 is passed through the OR gate 128 and applied to the adder 118 via the OR gate 122. Upon reception of the clock pulse, the adder 118 operates to add the digital signals from the A/D converter 116 and the latch 120. The sum obtained by the adder 118 is latched in the latch 120, after a predetermined very short time.

The digital signal latched in the latch 120 is applied as the needle position control signal to the bight control circuit 96 via the multiplexor 94. The bight control circuit 96 controls the bight control motor 100 by an amount determined by the needle position signal, in the direction determined by the same signal. Consequently, the needle-bar oscillator 36 is jogged in the lateral direction with respect to the feed direction of the work fabric 70, until the sensor 54 has been moved to a position at which the detection signal thereof coincides with the reference signal from the variable resistor 112. The frequency of the clock pulse is determined so as to permit the oscillator 36 to complete its movement to its lateral position at which the detection and reference signals coincide with each other, during a time period between the two successive clock pulses.

As a result of the coincidence of the detection signal with the reference signal, the error signal produced as the output of the comparator 114 is zeroed, and the digital signal from the A/D converter 116 to be added to the adder 118 is also zeroed. Therefore, the output of the adder 118 obtained by addition of the digital signals upon reception of the next clock puse is equal to the value currently maintained in the latch 120. Accordingly, the same value is again latched in the latch 120, after the predetermined short time. That is, the needle position control signal to be applied to the bight control circuit 96 via the multiplexor 94 is unchanged, whereby the bight control motor 100 and the needle-bar oscillator 36 are held at rest.

The lateral position of the needle 42 is changed as the needle-bar oscillator 36 is moved in the lateral direction, whereby the lowered position of the needle 42 in the lateral direction is determined by the magnitude of the reference signal generated by the variable resistor 112. If the lateral position of the needle 42 does not meet a desired distance between the edge of the work fabric 70 and a line of stitches to be formed on the fabric 70, the reference signal of the variable resistor 112 may be changed by operating the operator-controlled width setting member 28 previously described. With the reference signal changed, the same operation as described above is performed to change the lateral position of the support member 36 and consequently the lateral position of the needle 42 at its lowered position. The manipulation of the width setting member 28 by the operator is stopped at the moment when the lateral position of the needle 42 lies on the desired line of stitches to be formed on the fabric 70. After completion of the stitch width or the distance between the edge of the work fabric 70 and the line of stitches to be formed, the main switch 20 is turned on to start the needle drive motor. As a result, the successive stitches are formed by the needle 42 on a line which is away from the edge by a predetermined distance determined by the setting of the width setting member 28. The work fabric 70 is fed at a rate determined by the feed data from the stitch data generator 82, and the feed adjusting data from the feed adjusting the circuit 89, i.e., determined by the adjusted feed data received from the feed calculating circuit 84, as in an ordinary mode of operation.

During the sewing operation with the work fabric 70 automatically fed, the operator handles the work fabric 70 so as to hold the desired distance between the fabric edge and the intended line of stitches to be formed along the edge. Nevertheless, it is inevitable that the stitches are formed off the intended line. More specifically, in the event that the lateral position of the needle 42 deviates from the intended line along the fabric edge, the detection signal generated by the sensor 54 becomes different from the reference signal generated by the variable resistor 112. In consequence, the error signal is fed from the comparator 114 and applied to the adder 118 via the A/D converter 116. During the sewing operation, the timing pulse TP generated by the timing pulse generator 88 is applied through the OR gate gate 122 to the adder 118. In response to this timing pulse TP, the adder 118 operates to add the digital signal from the latch 120, to the digital signal from the A/D converter 116. Subsequently, the bight control motor 100 is controlled in the same manner as practiced when the width setting member 28 is operated while the machine is at rest. Namely, needle-bar oscillator 36 is laterally moved until the detection signal from the sensor 54 coincides with the reference signal from the variable resistor 112. Thus, the lateral positions of the needle-bar oscillator 36 and the needle 42 are changed so as to establish the desired distance between the fabric edge and the line of stitches to be formed. As described above, when the fabric is not fed along the intended line of stitches, the lateral position of the needle 42 is automatically adjusted so as to follow the edge of the work fabric 70, or so as to maintain the predetermined stitch width as measured from the edge of the work fabric 70, whereby the stitches may be formed on a line which is away from the fabric edge by a predetermined constant distance.

It will be understood that the detection signal produced by the sensor 54 is constant as long as the stitch width is held constant, provided that the work fabric 70 is plain or solid-colored. If the work fabric 70 is a checkered or otherwise figured fabric having portions of different colors, however, the amount of light which is reflected by the work fabric 70 may be varied. In this case, it is presumed that the amount of light received by the photoelectric cell 58, and the value of the detection signal of the sensor 54 may be varied, even while the distance between the fabric edge and the stitch line is held unchanged. To confirm the existence of the above possibility, fabric guiding tests were conducted on the instant sewing machine, by using three different workpieces: black paper, white paper and blue-serge fabric. These three materials were set on the sewing machine with their edges held in the same condition. The tests revealed substantially no difference in the lateral position of the needle 42, depending upon the specific kind of the workpiece.

Figure 4:
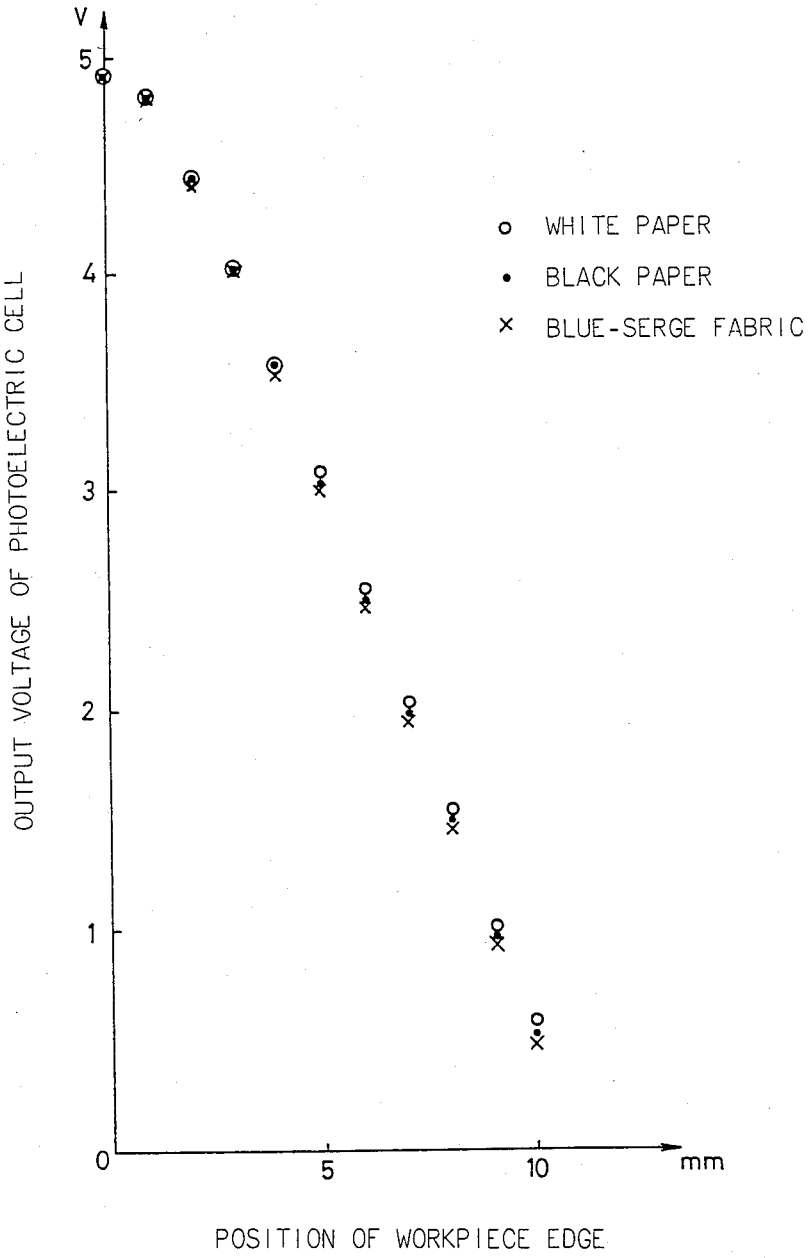
FIGS. 4 and 5 are graphs showing results of comparative tests of a photoelectric sensor for detecting the position of the edge of a workpiece, where the sensor is of a light reflection type, and where the sensor is of a light transmission type.
Figure 5:
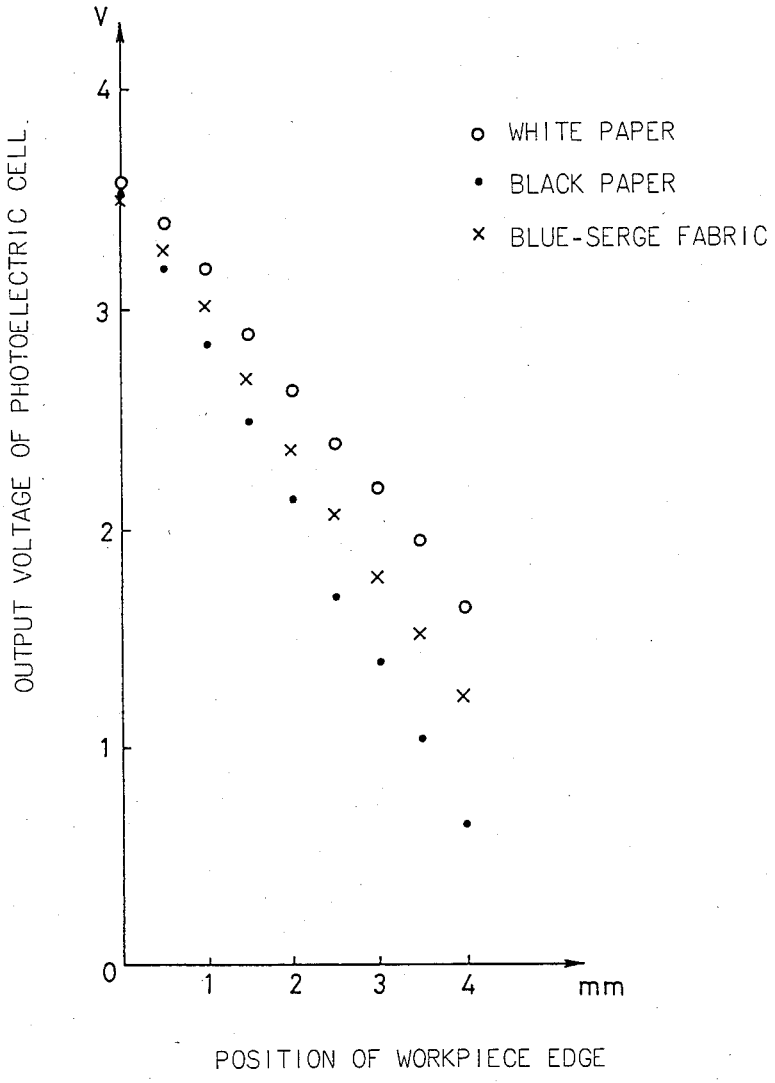

In the illustrated embodiment, the light emitting and receiving portions in the form of the light emitter 54 and the photoelectric cell 56 of the sensor 54 are disposed so that the sensor 54 operates as a detector of a light-reflection type, with the cell 56 adapted to receive the light reflected by the reflecting surface 74. However, the light emitter 54 and the photoelectric cell 56 may be disposed so that the sensor 54 operates as a detector of a light-transmission type wherein the photoelectric cell 56 is adapted to receive the light transmitted through the work fabric 70. Comparative tests were conducted in an unilluminated room, with the optical filter 60 removed, to compare the sensing capability of the light-reflection type sensor 54 with that of the light-transmission type sensor 54. The test results of the light-reflection and light-transmission types are indicted in FIGS. 4 and 5, respectively. As is apparent from the graph of FIG. 4, the output voltage of the photoelectric cell 58 adapted to receive the reflected light was substantially the same for all the three workpieces (black paper, white paper and blue-serge fabric), irrespective of the edge position of the workpiece with respect to the detection area of the sensor, that is, irrespective of the distance of lateral deviation of the workpiece edge from the predetermined point. On the other hand, the output voltage of the cell 58 adapted to receive the transmitted light, had a considerable variation depending upon the kind of the workpiece. The output voltage variation was increased as the area of the cell 58 covered by the workpiece was increased (as the distance of lateral deviation of the workpiece edge was increased), as indicated in FIG. 5. In this sense, it is advantageous to use the sensor 54 as the light-reflection type than as the light-transmission type.

The stitch width or the distance between the fabric edge and the desired line of stitches to be formed may be varied in the illustrated embodiment, by operating the width setting member 28 and thereby changing the value of the reference signal produced by the variable resistor 112. However, it is possible to apply a predetermined constant reference signal to the comparator 114, where it is not required that the stitch width be variable.

Although the illustrated embodiment is adapted to adjust the lateral position of the needle 42 into alignment with a desired line of stitches, with the width setting member 28 before the sewing operation is started, the clock generator 126 and the AND gate 128 may be eliminated if such a prior adjustment of the needle position is not needed.

In the illustrated embodiment, the needle position is adjusted by manipulating the width setting member 28 while observing the position of the needle 42 relative to the edge of the work fabric 70. For easy setting of the stitch width, it is possible to provide a scale in the vicinity of the width setting member 28, so that the operator may know the lateral position of the needle 42 by reading the position of the setting member 28 on the scale.

As previously described, the illustrated embodiment of the sewing machine is adapted to automatically select the straight stitch pattern upon selection of the tracing mode, since the straight stitches are commonly used in the tracing mode of operation following the edge of the work fabric. However, other suitable stitch patterns may be selected for the tracing mode.

It will be obvious that other changes, modifications and improvements may be made in the overall arrangement of the zig zag sewing machine of the present invention, or in the specific construction of the individual components such as the sensor 54, tracing control device 110 and needle-bar oscillator 36. For instance, the needle-bar oscillator 36 may be constructed so that it is pivotable or joggable about a substantially vertical axis, vertical, so as to permit a change in the lateral position of the needle 42 with respect to the feed direction of the work fabric 70.

What is claimed is:

1. A zig zag sewing machine having a feed device for feeding a workpiece in a feed direction on a work bed, an endwise reciprocable needle bar for carrying a needle, and a support member joggable laterally with respect to the feed direction and supporting the needle bar, comprising:

detecting means having a light emitting portion and a light receiving portion and disposed in the vicinity of said needle bar, for detecting the edge of said workpiece extending in said feed direction, said detecting means being movable laterally with respect to said feed direction in a predetermined positional relation with said support member at least when said support member is laterally moved;

driving means for changing the lateral positions of said support member and said detecting means; and control means for controlling said driving means so that an amount of light received by said light receiving portion coincides with a predetermined amount, whereby successive stitches formed by said needle are placed on a line which is away from said edge of the workpiece by a predetermined distance.

2. A zig zag sewing machine according to claim 1, wherein said detecting means is mounted on said support member.

3. A zig zag sewing machine according to claim 1, further comprising a light reflection surface provided on said work bed so as to extend laterally with respect to said feed direction, and wherein said light emitting portion and said light receiving portion are disposed above said light reflecting surface.

4. A zig zag sewing machine having a feed device for feeding a workpiece in a feed direction on a work bed, an endwise reciprocable needle bar carrying a needle, and a support member joggable laterally with respect to the feed direction and supporting the needle bar, comprising:

detecting means having a light emitting portion and a light receiving portion and mounted on said support member for detecting the edge of said workpiece extending in said feed direction;

driving means having a control motor operatively connected to said support member and operative to change the lateral positions of said support member and said detecting means; and control means for controlling said driving means so that an amount of light received by said light receiving portion coincides with a reference amount which is predetermined based on a distance between said edge and a line of successive stitches to be formed by said needle.

5. A zig zag sewing machine according to claim 4, further comprising a light reflecting surface provided on said work bed so as to extend laterally to said feed direction, and wherein said light emitting portion and said light receiving portion are disposed above said light reflecting surface.

6. A zig zag sewing machine according to claim 4, further comprising operator-controlled means operable to adjust said reference amount.

7. A zig zag sewing machine having stitch forming instrumentalities including an endwise reciprocable needle joggable laterally with respect to a feed direction of a workpiece, comprising:

detecting means having a light emitting portion and a light receiving portion for detecting an edge of said workpiece extending in said feed direction;

driving means for changing the lateral position of said needle;

first generating means for generating a timing signal in timed relation with reciprocation of said needle;

second generating means for generating a clock signal at a predetermined period while said needle is at its elevated position; and control means responsive selectively to said timing signal or said clock signal for controlling said driving means according to an amount of light received by said light receiving portion, whereby successive stitches formed by said needle are placed on a line which is a predetermined distance away from the edge of said workpiece.

* * * * *